US005161614A

United States Patent [19]

Wu et al.

[11] Patent Number: 5,161,614

[45] Date of Patent: Nov. 10, 1992

[54] APPARATUS AND METHOD FOR ACCESSING THE CASING OF A BURNING OIL WELL

[75] Inventors: Nanping Wu, Madison; Carl R. Marschke, Phillips, both of Wis.

[73] Assignee: Marguip, Inc., Phillips, Wis.

[21] Appl. No.: 708,161

[22] Filed: May 31, 1991

[51] Int. Cl.[5] ..... E21B 35/00

[52] U.S. Cl. ..... 166/277; 155/297; 155/376; 155/55

[58] Field of Search ..... 166/277, 297, 302, 376, 166/55, 57; 137/318

[56] References Cited

U.S. PATENT DOCUMENTS

| | | | |
|---|---|---|---|
| 1,879,160 | 9/1932 | Fowzer . | |
| 2,840,166 | 6/1958 | Eckel et al. | 166/55 |
| 3,532,113 | 10/1970 | McKean | 137/318 |
| 3,603,387 | 9/1971 | Schoeffler | 166/55 |
| 3,693,715 | 9/1972 | Brown | 166/55 |
| 3,699,996 | 10/1972 | Nichols | 137/318 |
| 3,717,202 | 2/1973 | Burrow | 166/55 |
| 3,738,424 | 6/1973 | Osmun et al. | 166/57 X |
| 3,993,137 | 11/1976 | Hefetz | 166/297 X |
| 4,108,194 | 8/1978 | Harrison et al. | 137/15 |
| 4,516,598 | 4/1985 | Stupak | 137/318 |
| 4,552,170 | 11/1985 | Margrave | 137/318 |

*Primary Examiner*—Terry Lee Melius

*Attorney, Agent, or Firm*—Andrus, Sceales, Starke & Sawall

[57] ABSTRACT

An apparatus for providing access to the casing of a burning oil well near the wellhead includes a sled-like carriage which is moved over the ground surface into a position straddling the well casing. A heat shield carried by the sled shields personnel and equipment thereon from the well fire. An excavator is mounted on the sled behind the heat shield for movement toward and beneath the heat shield to excavate a cavity around the well casing. A platform apparatus on the sled, including a pair of jaws openable to allow receipt of the casing, covers the excavated cavity into which a known well plugging device is moved for attachment to the well production pipe after the outer casing is cut away.

11 Claims, 2 Drawing Sheets

APPARATUS AND METHOD FOR ACCESSING THE CASING OF A BURNING OIL WELL

BACKGROUND OF THE INVENTION

The present invention relates to an apparatus and method of use for directly accessing the casing of a burning oil well preparatory to shutting off the flow therein. More particularly, the apparatus and method contemplate access to the casing directly adjacent the wellhead and near the ground surface.

In co-pending and commonly assigned application Ser. No. 697,398, filed May 9, 1991 and entitled "Directly Installed Shut-Off Valve Assembly For Flowing High Pressure Line", there is disclosed an apparatus for installing a reopenable shut-off valve in a flowing oil well casing. Also disclosed are a method for accessing the well casing below the surface of the ground by tunneling and for removing outer well casing layers to provide direct access to the oil production casing or pipe. The shut-off valve installation assembly disclosed in the above identified application may be applied and used on a well casing at virtually any point along its length. However, when the well is out of control and on fire, accessing the casing at some point substantially below the ground surface, by tunneling, protects the operation from heat and related hazards encountered at the wellhead. Nevertheless, tunneling methods are tedious, expensive and time consuming. Furthermore, the access tunnel becomes a more or less permanent installation without any substantial utility after the well has been brought under control and the fire extinguished.

Therefore, it would be desirable to have some other means for providing access to the well casing near the wellhead at the surface of the ground which would obviate tunneling. However, any such means would have to provide protection against the heat and related hazards of the burning wellhead. Also, it would be desirable to provide an apparatus which could be removed after the well has been brought under control and reused at other well sites.

SUMMARY OF THE INVENTION

In accordance with the present invention, an apparatus and related method provide access to the casing of a burning oil well at the wellhead near the ground surface so that the outer casing layers may be cut away to expose the production casing in accordance with prior art techniques, all in a protected and efficient manner.

The basic apparatus of the present invention includes a carriage which is adapted to be moved over the ground surface and into a position with the forward end of the carriage straddling the casing closely adjacent the wellhead. A large heat shield is mounted on the carriage and is positionable therewith adjacent the casing to shield personnel and apparatus on or near the rear of the carriage from the well fire. A pair of horizontally articulable jaws are mounted on the carriage in a position to surround the casing when the jaws are open and the carriage is in a position straddling the casing, each of the jaws including a semicircular notch which together enclose and clamp the casing when the jaws are closed. Excavating means are also mounted on the carriage behind the heat shield and are adapted to move toward and beneath the heat shield and the jaws to excavate ground surface material and provide an access cavity surrounding the casing below the wellhead. When closed, the jaws define at least a portion of a protective horizontal platform which surrounds and extends radially away from the casing and covers the excavated cavity. The apparatus also includes means for moving the carriage, means for articulating the jaws and means for operating the excavating means.

In accordance with the preferred embodiment, the carriage comprises a relatively simple sled having a pair of spaced parallel runners adapted to slide over the ground surface. The heat shield preferably comprises a steel plenum having a width at least as wide as the carriage and which extends upwardly from the carriage and forwardly over the wellhead to deflect the flames from the burning well. The heat shield plenum may be supplied with air from a blower mounted on the carriage to help cool the plenum surface directly facing the fire. The jaws may be adapted to be water-cooled to help protect the excavation site and any personnel working thereunder from excessive heat. The cooling water supplied to the jaws may also be diverted into the heat shield plenum for supplemental cooling thereof.

In the preferred embodiment, a pair of horizontal platform sections extend inwardly from the sled runners and have opposed spaced inner edges defining a slot in which the casing is received. The jaws are mounted to operate directly above the platform section and slot and, in the closed position, the jaws span the slot to provide the protective platform.

The jaws may be mounted on the carriage for vertical movement with respect thereto, thereby enabling the jaws to be moved vertically downwardly into the excavation provided thereunder. The excavating means preferably comprises three continuous conveyor type trenchers cooperatively mounted on the carriage parallel to one another and extending downwardly at an angle under the jaws. The trenchers may be mounted for simultaneous downward movement along the line of their angular inclination and forwardly along the carriage.

The carriage sled may be adapted to be pushed into position by a separate self-propelled vehicle such as a bulldozer. Suitable conveying means may also be attached to the carriage to receive ground material from the excavators and carry the same away from the work site. The carriage also preferably includes means for supporting and carrying the device for plugging the production casing and related equipment, including suitable rigging and transfer mechanism to assist in positioning the device in the excavated cavity at the well casing below the protective platform.

DETAILED DESCRIPTION OF THE PREFERRED EMBODIMENT

Figure 1:
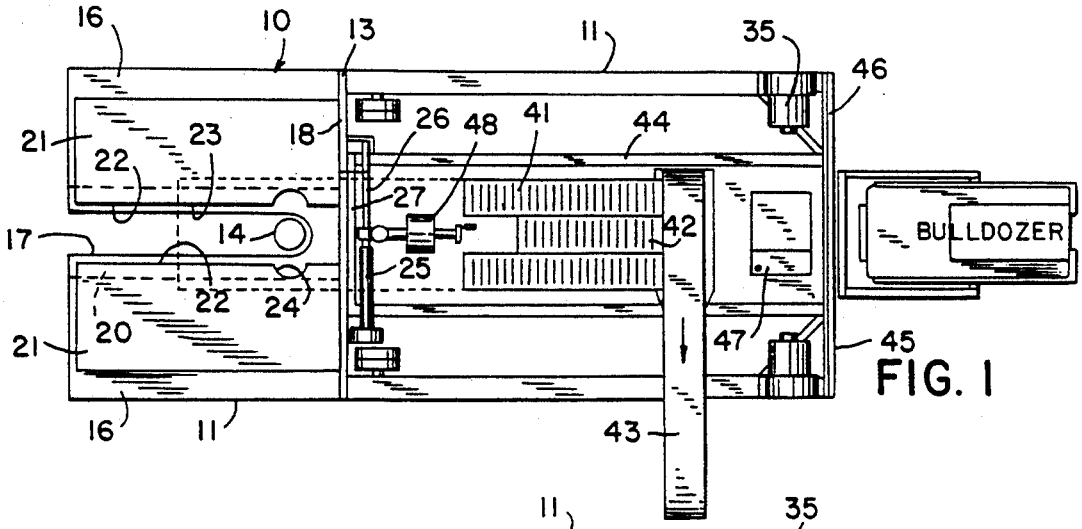
FIG. 1 is a top plan view of the carriage for the apparatus of the present invention being moved into position around the well casing.
Figure 2:
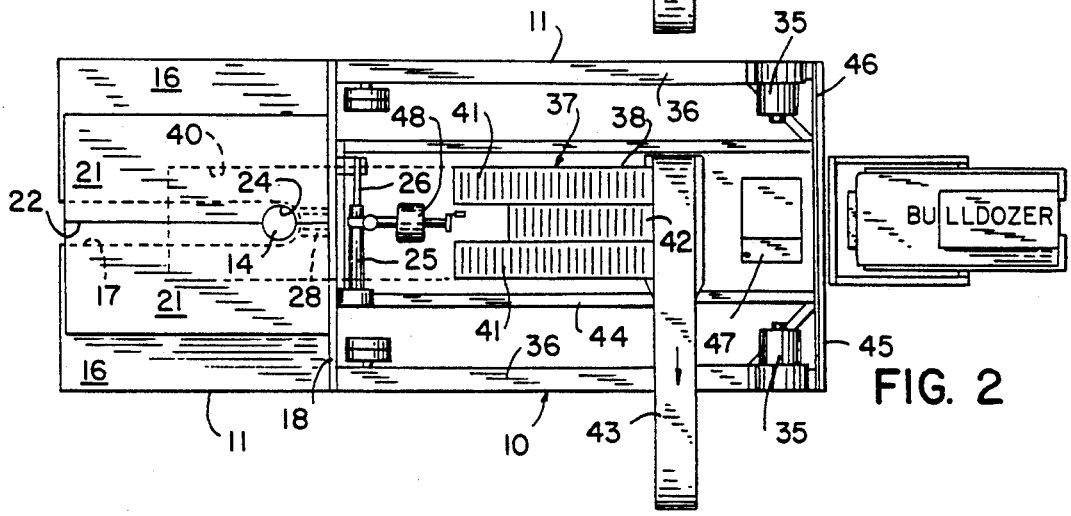
FIG. 2 is a top plan view similar to FIG. 1 showing the jaws closed around the well casing and forming the protective horizontal platform.
Figure 3:
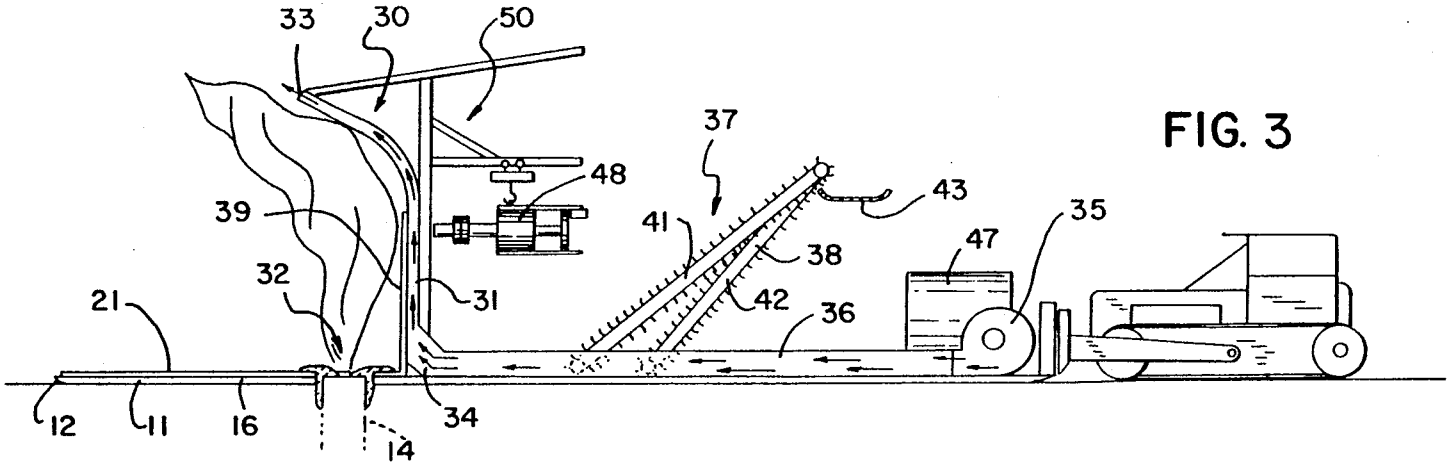
FIG. 3 is a side elevation of the apparatus of the present invention positioned around the casing, but before excavation.

Referring initially to FIGS. 1-3, the carriage for the apparatus of the present invention comprises a sled 10 having a pair of parallel spaced runners 11. The runners have wide flat ground engaging surfaces and upturned ends 12 (in the manner of skis) so that the sled may be pushed or pulled over the ground surface. Although the carriage may be operated over virtually any type of ground surface, the apparatus to be described hereinafter is particularly adapted for use in an arid or desert environment in which the soil or ground surface material is substantially all dry sand.

The sled runners 11 may be made from relatively heavy steel structural members, such as H-sections, and are interconnected by suitable structural cross members 13 to provide a rigid, but substantially open structure. The forward end of the sled 10 must be sufficiently open and unobstructed to allow the well casing 14 to be received between the runners 11 as the sled is moved into operative position with the runners straddling the casing on opposite sides thereof.

In the presently preferred embodiment, a pair of horizontal shielding platform sections 16 are attached to the forward inside edges of the runners 11 to define therebetween a longitudinal casing-receiving slot 17 extending rearwardly from the forward edge of the sled. The slot 17 preferably has a width just slightly larger than the maximum diameter of the casing 14. The forward corners of the platform sections 16 may be appropriately angled to provide lead-in surfaces to assist in positioning the sled. Preferably, the platform sections are made of an insulating, heat resistant material, such as fire brick. The platform sections extend rearwardly to supporting attachment to the forward cross member 18. Suitable framing members 20 may also be provided to support the forward edges of the platform sections as well as the longitudinal edges thereof along the slot 17.

A pair of jaws 21 movable in a horizontal plane between an open and a closed position are supported on the forward cross member 18 and extend forwardly over the inner edges of the platform sections 16 defining the slot 17. In their open position, the jaws 21 are separated laterally such that the opposed jaw edges 22 define a jaw slot 23 approximately the same width as the slot 17 defined by the platform sections 16. Each of the jaw edges 22 includes a semicircular notch 24 having a diameter approximately equal to the maximum diameter of the casing 14. The edges of the notches 24 may be provided with a compressible, heat resistant sealing material, but the sealing material is optional.

The sled 10 is moved forwardly so that the casing 14 is first received in the slot 17 and then the jaw slot 23 until the casing is positioned between the notches 24 in the open jaws. As shown in FIG. 2, the jaws are then closed to enclose and clamp the casing 14 therebetween. To effect closure of the jaws 21, the rearward edges of the jaws are interconnected by a fluid cylinder 25 in a manner such that retraction of the cylinder rod 26 causes the jaws to move together and close on the casing 14. Other suitable operators may also be utilized to effect jaw closure and reopening and the rearward edges of the jaws may also be mounted on a suitable synchronizing track mechanism 27 on the forward cross member 18 to provide simultaneous identical movement of the jaws in respective opposite directions as the cylinder 25 is retracted or extended.

With the jaws 21 in the closed position shown in FIG. 2, the slot 17 between the platform sections 16 near the casing 14 is also covered and substantially closed to define a substantially continuous horizontal platform surrounding and extending radially in all directions from the casing. To enhance the seal between the edges of the notches 24 and the casing 14, a hardenable sealing material, such as plaster of paris, may be pumped from the rear of the sled 10 through suitable flow passages 28 in the jaws to openings in the notches 24 from which it may flow around and seal the interface between the casing and the notches.

It is important to shield the rearward portion of the sled 10, other equipment carried thereon, and any operating personnel from the heat of the fire and a heat shield 30 is provided for this purpose. In its preferred embodiment, the heat shield 30 comprises a large generally rectangular plenum 31 extending at least the full width of the sled (for example, 25 to 30 feet) and upwardly therefrom and curving forwardly over the wellhead 32 at the top of the casing 14. The shield 30 provides a direct barrier to the flames and heat generated by the burning oil flowing out of the wellhead and the curved upper portion also deflects the flame toward the front of the sled. The plenum 31 is substantially closed except for an open upper end 33 and lower inlet openings 34. Blowers 35 are mounted to the rear of the sled to supply cooling air to the inlet openings 34 via air ducts 36. The flow or air through the plenum 31 and out the open upper end 33 cools the forward face of the heat shield 30 directly in contact with the flames. The forward face of the shield may also be covered by an insulating layer 39, such as fire brick.

Figure 4:
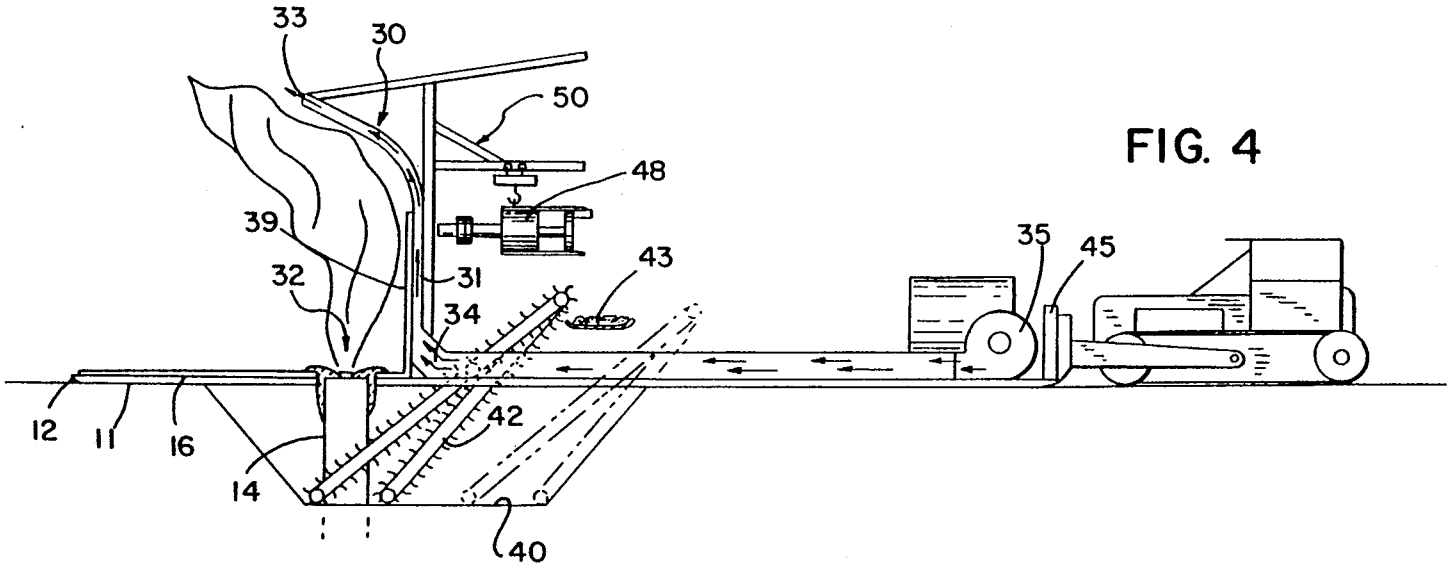
FIG. 4 is a side elevation similar to FIG. 3 showing the excavating means in operative position to provide the excavation around the well casing under the platform.

Mounted on the sled rearwardly of the jaws and the heat shield is an excavating means, preferably comprising three trenching-type excavators 37 mounted in a unitary array and extending downwardly and forwardly at an angle with respect to the horizontal plane of the sled. Each of the excavators 37 may comprise a conventional trencher of the type utilizing a series of excavating flights mounted on a continuous carrying chain to pick up ground surface material at the lower forward end and convey it upwardly and rearwardly for discharge and removal at the opposite end. The excavators 37 are mounted in a common track mechanism 38 allowing them to be slid downwardly and forwardly from their FIG. 3 position to the FIG. 4 position with the lower ends of the excavators disposed under the heat shield and the platform formed by the jaws and platform sections.

In a preferred arrangement, two outer excavators 41 are mounted on opposite sides and forwardly of a center excavator 42. In this manner, as the excavators move downwardly and forwardly on the track mechanism 38 to excavate the cavity 40, the outer excavators 41 will pass on opposite sides of the casing 14 and, when the desired depth of the excavated cavity has been reached, the lower end of the center excavator will be positioned just rearwardly of the casing. Excavated material, such as sand, is discharged from the upper ends of the excavators 37 to laterally disposed conveyors 43 which carry the sand away from the sled. The conveyors 43 as well as the track mechanism 38 is supported by lower frame members 44 mounted between the sled runners 11.

A large pusher plate 45 is attached to a rear cross member 46 connecting the rear ends of the runners 11, the pusher plate extending rearwardly for engagement by a bulldozer or the like to push the sled into operative position. It may also be desirable to provide cooling water for the jaws or for injection into the heat shield plenum 31. Also, reservoirs for the hardenable slurry for sealing the jaws may also be desirable. Water and/or slurry tanks 47 may be conveniently mounted on the upper frame members 44 at the rear sled, as shown.

Figure 5:
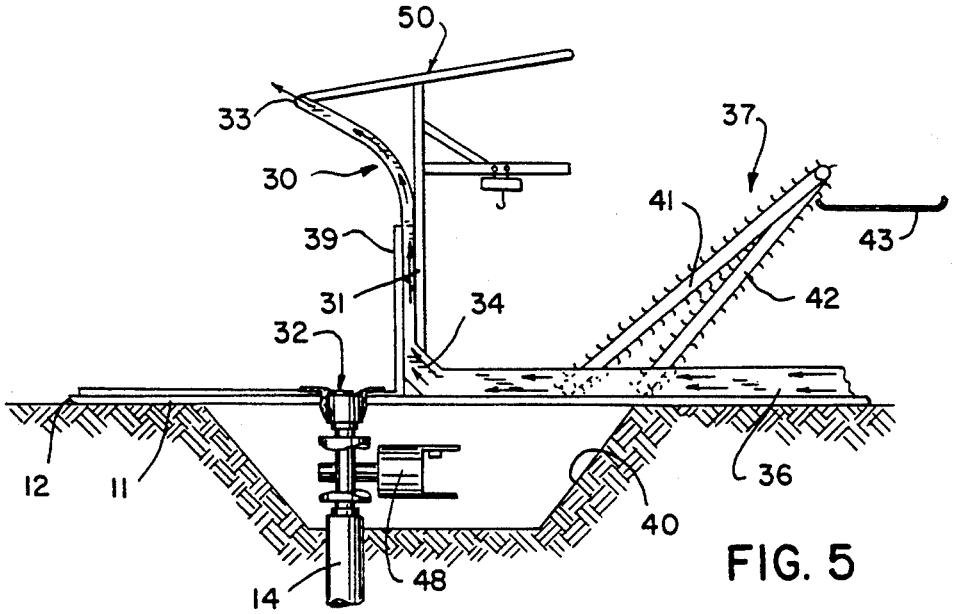
FIG. 5 is a partial side elevation similar to FIGS. 3 and 4 showing the apparatus after installation of the device for plugging the production casing.

An upper frame member 50 provides additional support for the upper portion of the heat shield 30 and, at a point immediately to the rear of the heat shield, a well plugging device 48 of the type described in the above identified co-pending application may be supported on suitable lift mechanism by which it can be lowered into the cavity 40 after excavation is completed and the excavators 37 withdrawn. As may be seen in FIGS. 3–5, the excavated cavity 40 is always fully spanned by the sled runners 11 such that the sled is maintained in a stable horizontal position. The unsupported forward ends of the jaws 21 preferably extend slightly beyond the forward edge of the cavity 40, thereby completely covering and enclosing the cavity from the overhead fire.

In a modified embodiment, the platform sections 16 may be eliminated and the jaws 21 substantially enlarged laterally in opposite directions. In this manner, the jaws alone provide a cavity-covering platform. The outer lateral edges of the jaws in this embodiment could even be extended laterally beyond the sled runners 11 when the jaws are open, so that complete coverage of the cavity may still be effected when the jaws are closed and the outer lateral edges thereof moved inwardly. In this embodiment, without the platform sections 16, the jaws 21 along with the operating cylinder 25 and track mechanism 27 may be mounted for vertical movement with respect to the sled. In this manner, if desired or if necessary to avoid a wellhead obstruction, the opened jaws may be lowered some distance into the cavity 40 after excavation to a more suitable position on the casing 14 for clamping and sealing.

We claim:

1. An apparatus for accessing the casing of a burning oil or gas well near the wellhead and the ground surface, said apparatus comprising:

a carriage adapted to be moved over the ground surface to a position straddling the casing;

a heat shield mounted on the carriage and positionable therewith adjacent the casing;

a pair of horizontally articulate jaws mounted on the carriage in a position to receive the casing therebetween when the jaws are open and the carriage is in the straddling position;

said jaws including complimentary notches adapted to enclose and clamp to the casing when the jaws are closed;

excavating means, attached to the carriage in a position shielded from the wellhead by the heat shield, for movement toward and beneath the heat shield and the jaws to excavate ground surface material and provide an access cavity around the casing below the wellhead;

means including said closed jaws defining a horizontal platform, surrounding and extending radially from the casing for covering said cavity; and, means for moving the carriage, for operating the articulating jaws, and for operating the excavating means.

2. The apparatus as set forth in claim 1 wherein the carriage comprises a sled having a pair of spaced parallel runners adapted for sliding movement over the ground.

3. The apparatus as set forth in claim 1 wherein the heat shield comprises a hollow plenum extending upwardly from the carriage and over the wellhead.

4. The apparatus as set forth in claim 3 including means for supplying cooling air for the plenum.

5. The apparatus as set forth in claim 1 wherein said means for covering said cavity comprises:

a pair of platform sections attached to the carriage and having opposing opposite edges spaced to form a slot for receipt of the casing when the carriage is in its casing-straddling position; and, said jaws positioned directly over said platform sections having a combined lateral width in the closed position sufficient to span the slot.

6. The apparatus as set forth in claim 1 wherein said excavating means comprises an array of excavators mounted at an angle with respect to the horizontal plane of the carriage for vertical and horizontal movement with respect to the carriage.

7. The apparatus as set forth in claim 1 including means for supplying a hardenable sealing material to the interface between the jaws and the casing when the jaws are closed.

8. A method for accessing the casing of a burning oil or gas well near the wellhead and the ground surface, said method comprising the steps of:

(1) moving an apparatus-supporting carriage over the ground surface with one end of the carriage in a position straddling the casing;

(2) positioning a heat shield on the carriage adjacent the casing with the carriage in the straddling position;

(3) mounting a pair of horizontally articulable jaws on the carriage in a position for receiving the casing therebetween when the jaws are opened and the carriage is in the straddling position;

(4) excavating an access cavity around the casing and below the heat shield and jaws; and, (5) covering said cavity with a horizontal platform, said platform including the jaws in the closed position.

9. A method for accessing and plugging the casing of a burning oil or gas well near the wellhead and the ground surface into which the well extends, said method comprising the steps of:

(1) supporting a fire and heat deflecting means on a movable carriage;

(2) supporting on said movable carriage means for forming a protective ground surface cover;

(3) moving the carriage over the ground surface to place the deflecting means in a position directly adjacent the wellhead to deflect the fire and heat from the well upwardly and away from the carriage and to place the cover forming means adjacent the deflecting means and the wellhead;

(4) operating the cover forming means to place a protective cover around the wellhead and over the ground surface, and supporting said cover at least partly with the carriage;

(5) excavating an access cavity around the casing below the ground surface and under the protective cover; and, (6) installing a shut-off valve on the casing in the access cavity.

10. The method as claimed in claim 9 including the step of mounting means for excavating the access cavity on the carriage.

11. The method as claimed in claim 9 including the step of supporting means for installing the shut-off valve on the carriage for movement into the access cavity.

* * * * *